United States Patent [19]

Shoji

[11] 4,359,787

[45] Nov. 23, 1982

[54] LAVATORY SEAT COVER FOR CLOSET

[76] Inventor: Satoshi Shoji, 3-9, 1-chome, Tsurukawa, Machida-shi, Tokyo, Japan

[21] Appl. No.: 194,705

[22] Filed: Oct. 6, 1980

[51] Int. Cl.[3] ..... A47K 13/14

[52] U.S. Cl. ..... 4/245; 4/242; 4/243; 4/244

[58] Field of Search ..... 4/242, 245, 243, 244, 4/247, 246

[56] References Cited

U.S. PATENT DOCUMENTS

| | | | |
|---|---|---|---|
| 972,269 | 10/1910 | Slough | 4/245 |
| 1,070,575 | 8/1913 | Batson et al. | 4/245 |
| 1,301,779 | 4/1919 | Young | 4/245 |
| 1,706,960 | 3/1929 | Kobatake | 4/245 |
| 2,160,100 | 5/1939 | Crawford | 4/245 |
| 3,348,243 | 10/1967 | Kelly | 4/245 |
| 3,579,669 | 5/1971 | Loewenstein | 4/245 |

*Primary Examiner*—Henry K. Artis

[57] ABSTRACT

A lavatory seat cover for a closet is disclosed which includes back board of horseshoe or elliptical shape to fit the shape of the lavatory seat, a laminate of stacked lavatory seat cover sheets of the same shape as the back board to be secured onto the block board, adhesive tapes provided onto the bottom of the back board to secure the seat cover onto the lavatory seat, and edge nipping members of soft material provided at the peripheral edges of the back board and the laminate for securing the laminate to the back board. When a person uses the closet with the lavatory seat attached with the lavatory seat cover of the present invention thus constructed, he can sanitarily make always contact at the skin of his buttocks with the lavatory seat through new lavatory sheet by simply separating the old uppermost cover sheet of the stacked cover sheets of the laminate if the lavatory seat cover is placed and fixed in place onto the seat via the adhesive tapes.

8 Claims, 7 Drawing Figures

LAVATORY SEAT COVER FOR CLOSET

BACKGROUND OF THE INVENTION

This invention relates to a closet, and more particularly, to a lavatory seat cover for sanitarily coating the lavatory seat of the closet with thin paper of stacked sheets in a manner capable of removing only the top sheet every time a person uses the closet.

When a person utilizes a closet, it is advantageous for him to sit on the lavatory seat of the closet. He does not become fatigued upon use of the closet of this type as its merit. However, he makes direct contact at the skin of his buttocks with the lavatory seat at that time. In case that numerous people uses the closet or any person utilizes the closet as in a public lavatory, it is disadvantageous that the closet easily becomes insanitary or he might have bad feeling therein. It is, accordingly, desired to set a cover at the lavatory seat of the closet and to replace it sometimes. It is troublesome to attach or place the conventional cover onto the seat of the closet. In addition, it is unstable to displace the cover from the seat when using the closet, and accordingly difficult to utilize it with the cover to be impractical.

SUMMARY OF THE INVENTION

It is, therefore, an object of the present invention to provide a lavatory seat cover which can eliminate the aforementioned disadvantages of the conventional cover by enabling to simply separate only the top sheet of stacked sheet cover to renew the old lavatory seat cover if the cover is once attached to the lavatory seat.

It is another object of the present invention to provide a lavatory seat cover which does not stain the lower new sheets stacked under the top cover sheet in a closet.

It is a further object of the present invention to provide a lavatory seat cover which does not displace unstably nor put the stacked cover sheets into disorder on the lavatory seat of a closet in easily usable state.

It is still another object of the invention to provide a lavatory seat cover which cannot simultaneously remove several cover sheets when separating the top cover sheet to renew the old uppermost sheet on the lavatory seat.

It is still another object of the invention to provide a lavatory seat cover which is not eventually necessary to attach new lavatory seat cover onto the lavatory seat of the closet every time one uses the closet but can renew the old seat cover only by a simple operation.

The foregoing and other objects are achieved by a lavatory seat cover, in which a plurality of lavatory seat cover sheets of special shape are stacked on a back board having an attaching function to the lavatory seat of a closet to form a cover sheet laminate, which is so mounted on the lavatory seat as not to accidentally displace unstably nor put the stacked sheets into disorder, but as to be simply separated only at the uppermost cover sheet therefrom to renew and dispose only the top cover sheet every time one uses the closet.

BRIEF DESCRIPTION OF THE DRAWINGS

Other objects and advantages of the present invention will be apparent from the following detailed description taken in conjunction with the accompanying drawings in which.

DESCRIPTION OF THE PREFERRED EMBODIMENTS

Figure 1:
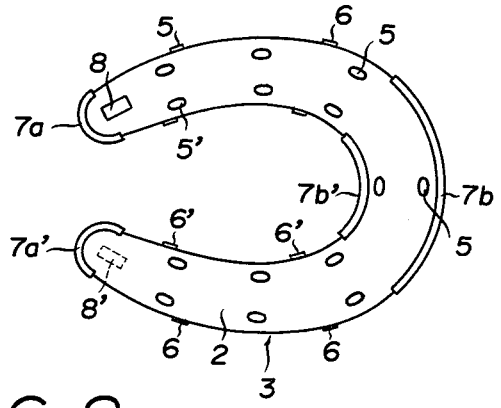
FIG. 1 is a plan view of one embodiment of the lavatory seat cover for a closet in accordance with the present invention.
Figure 2:
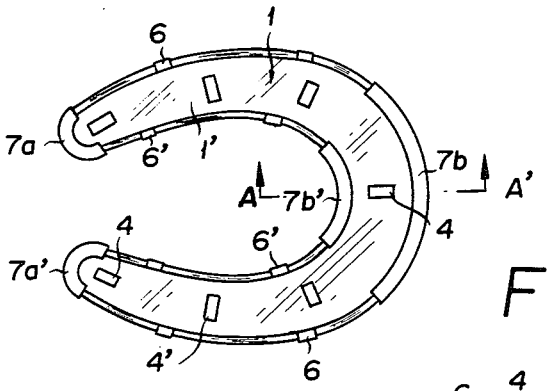
FIG. 2 is a bottom plan view of the lavatory seat cover shown in FIG. 1.

Referring to the drawings wherein like reference numerals designate the same parts in the several views, particular reference being had to FIGS. 1 and 2, wherein there is illustrated one embodiment of the lavatory seat cover for a closet for practicing the present invention, a plurality of lavatory seat cover sheets 2 are stacked to form a seat cover laminate 3 on the surface of a back board 1 for mounting itself on the lavatory seat B of a closet A of western style. The block board 1 is so cut and formed in a horseshoe or elliptical shape as to fit the shape of the lavatory seat B, and is formed of slightly thick board or synthetic resin or the like. A plurality of adhesive tapes 4, 4' are bonded in place to the back surface of the back board 1 in order to fix the block board 1 to the lavatory seat B.

The lavatory seat cover sheets 2 are formed of thin sheets of paper, and are so cut and formed in a horseshoe or elliptical shape as to be the same in shape as the back board 1. It is preferable that the cover sheets 2 are made of oiled paper or water-proof paper.

In accordance with the present invention, the cover sheets 2 are stacked to form a seat cover laminate 3 as previously described in such a manner that the stacked sheets 2 are so cut and formed as to be slightly larger in overall size than the one disposed adjacent thereto at the downside from the bottom to the top. The stacked sheets 2 are so laminated that the top or uppermost sheet is always slightly larger than the sheets located underneath the top sheet in order to completely coat the residual lower sheets when the uppermost sheet is separated one by one from the stacked sheets.

A plurality of recesses 5, 5' are formed in place on the cover sheets 2 so as to prevent any of the stacked sheets 2 from relatively moving therebetween.

In addition, the laminate 3 of the stacked sheets 2 is partially pasted at the side edges 6, 6' in order to prevent itself from accidentally displacing unstably or putting itself into disorder on the lavatory seat B of the closet A.

Further, at the peripheral side edges of the back board 1 and laminate 3 are in place provided side edge nipping members 7 of soft material such as soft synthetic rubber or the like for restricting the laminate 3 on the back board 1 so as to nip both the board 1 and cover sheets 2 or laminate 3 together. It is preferable that the members 7 are fixedly secured to the board 1.

Figure 3:
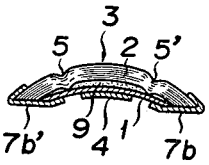
FIG. 3 is a sectional view of the lavatory seat cover attached onto the lavatory seat of the closet taken along the line A—A of FIG. 2.
Figure 4:
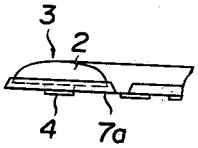
FIG. 4 is an end view of the essential portion showing the end of the lavatory seat with the seat cover.
Figure 7:
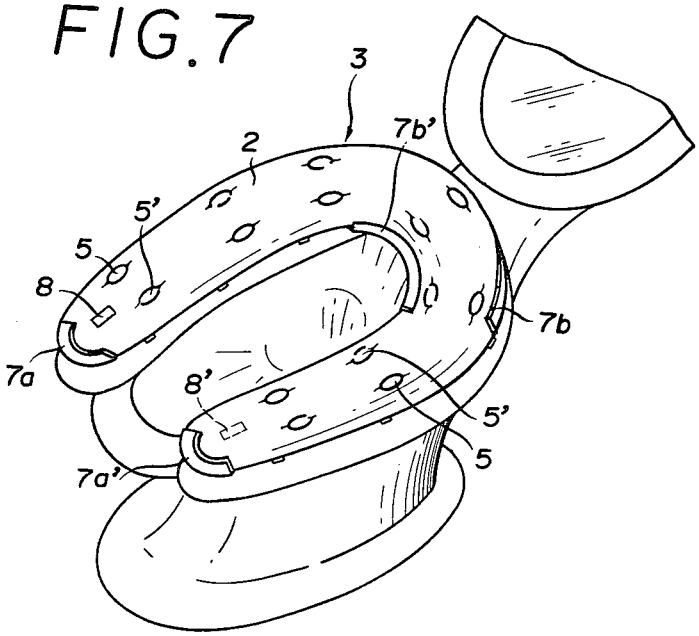
FIG. 7 is a perspective view of the lavatory seat cover attached to the lavatory seat of the closet showing the used state of the seat cover of the present invention.

Referring to FIGS. 3 and 4 in addition to the FIGS. 1 and 2, in case that both the board 1 and the cover sheets 2 of the laminate 3 are formed in horseshoe shape, the side edge nipping members 7 include side edge nipping member pairs 7a, 7a' secured to both right and left side ends of the lavatory seat B, and side edge nipping member pairs 7b, 7b' secured to both outside and inside edges of the rear portion of the lavatory seat B.

Figure 6:
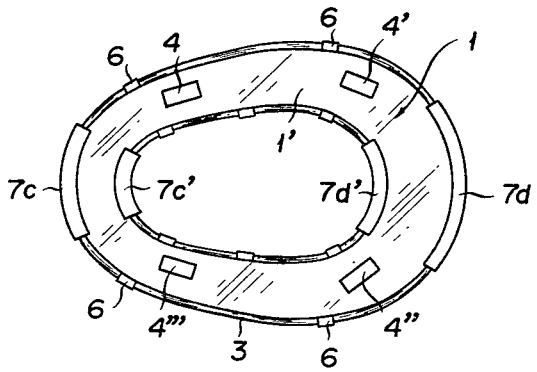
FIG. 6 is a bottom plan view of the lavatory seat cover shown in FIG. 5.
Figure 5:
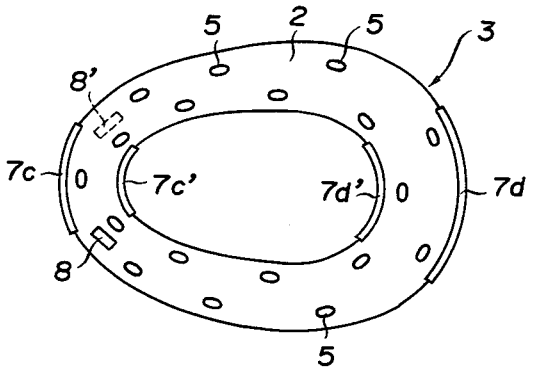
FIG. 5 is a plan view of another embodiment of the lavatory seat cover attached onto the lavatory seat of the closet in accordance with the present invention.

In FIGS. 5 and 6, in case that both the board 1 and the cover sheets 2 of the laminate 3 are formed in elliptical shape, the side edge nipping members 7 include front edge nipping member pairs 7c, 7c' secured to both front outside and inside edges of the lavatory seat B, and rear edge nipping member pairs 7d, 7d' secured to both rear outside and inside edges of the lavatory seat B.

The edge nipping members 7 thus constructed and secured fixedly secure the laminate 3 to the back board 1 so that several lavatory seat cover sheets 2 may not be simultaneously separated from the stacked cover sheets 2 and may not be put into disorder when the top cover sheet 2 is removed from the stacked cover sheets 2 on the lavatory seat B.

Referring back to FIGS. 1 and 2, a plurality of tongue pairs 8, 8' are alternatively attached in place at both right and left side end portions of the lavatory seat of horseshoe shape to every other cover sheets 2 to be used so as to separate the top cover sheet 2 from the stacked cover sheets 2.

Referring further back to FIGS. 5 and 6, a plurality of tongue pairs 8, 8' are similarly alternatively attached in place at both right and left front side portions of the lavatory seat of elliptical shape to every other cover sheets 2 to be used similarly so as to separate the top cover sheet 2 from the stacked cover sheets 2 to those shown in the above FIGS. 1 and 2.

In back FIG. 3, though bottom cover sheet of the stacked cover sheets 2 can be pasted or bonded via an adhesive tape to the back board 1, it is preferred that a sponge 9 fixedly secured to the board 1 is interposed between the bottom cover sheet 2 and the board 1 in such a manner that the sponge 9 is disposed in engagement with the recesses 5, 5' of the cover sheets 2 in order that any of the stacked cover sheets 2 of the laminate 3 may not displace unstably from the back board 1 nor put itself into disorder. The sponge 9 thus located and engaged operates as cushion so as to improve the sitting feeling of a person using the closet.

When a person uses the closet A with the lavatory seat B on which the laminate 3 of a plurality of lavatory seat cover sheets 2 stacked on the back board 1 as described above in accordance with the present invention is set via the adhesive tapes 4, 4', he can sanitarily make always contact at the skin of his buttocks with the lavatory seat B via new lavatory sheet 2 by simply separating the old uppermost cover sheet 2 of the stacked cover sheets 2 of the laminate 3 until all the stacked cover sheets 2 are wasted if the lavatory seat cover thus constructed according to the present invention is placed and fixed in place onto the lavatory seat B via the adhesive tapes 4, 4' provided underneath the back board 1.

It should be appreciated that since the stacked sheets 2 of the laminate 3 are so formed as to be slightly larger in overall size that the one disposed adjacent thereto at the downside from the bottom to the top and to be in the similar shape as was previously described, the top sheet of the stacked sheets is always completely coating the lower cover sheets when the uppermost sheet is separated one by one from the stacked sheets so as not to stain the lower sheets under the top sheet.

It should also be seen that since the laminate 3 of the stacked lavatory seat cover sheets 2 thus superimposed in advance is mounted onto the lavatory seat B of the closet A according to the present invention, the user is not necessary to attach new lavatory seat cover onto the lavatory seat B every time he uses the closet but can renew the old seat cover only by removing the top of the stacked cover sheets of the laminate 3.

It will be seen that since the lavatory seat cover of the present invention comprises the recesses 5, 5' formed in place on the cover sheets 2 of the laminate 3, edge nipping members 7 provided in place at the peripheral side edges of the board 1 and the laminate 3, and pasted side edges 6, 6' provided partially at the lamitate 3 of the stacked sheets 2, any of the stacked sheets 2 of the laminate 3 may not accidentally displace unstably nor put itself into disorder but can be always stably used when a person sits on the stacked sheets 2 to apply an external strength such as his weight to the laminate 3 of the stacked sheets 2.

Although two specific embodiments of the present invention have been described hereinbefore, it should be understood that numerous variations thereof may be employed without departing from the invention, and it is reiterated that the examples given as above are simply illustrative of the lavatory seat cover.

What is claimed is:

1. A lavatory seat cover for a water closet bowl comprising a back board which corresponds in shape and fits onto a lavatory seat;

a laminate comprising a plurality of thin sheets of material which correspond to the shape of said back board and are secured onto said back board, each one of said cover sheets defining a plurality of recesses over its surface area which recesses cooperate with the recesses defined in the underlying sheet to restrict lateral movement between the sheets;

adhesive means located on the back surface of said back board;

and a plurality of edge nipping members provided at the peripheral edges of said back board and said laminate for securing said laminate onto said back board.

2. A lavatory seat cover as in claim 1 in which said laminate is formed by stacking a plurality of lavatory seat cover sheets of similar shape to be slightly larger in overall size than the one disposed adjacent thereto at the downside from the bottom to the top.

3. A lavatory seat cover as in claim 1 in which a plurality of recesses are formed on the cover sheets of said laminate to prevent said laminate from putting into disorder.

4. A lavatory seat cover as in claim 1 in which the cover sheets of said laminate are formed of water-proof oiled paper.

5. A lavatory seat cover as in claim 1 in which said laminate of the stacked cover sheets is partially pasted at the side edges thereof.

6. A lavatory seat cover as in claim 1 in which edge nipping members are so formed of soft synthetic rubber or the like soft material as to nip said laminate of the stacked cover sheets together with said back board.

7. A lavatory seat cover as in claim 1 in which a plurality of tongue pairs are alternatively attached onto the upper surfaces of the stacked cover sheets to separate the top cover sheet from the stacked cover sheets one by one.

8. A lavatory seat cover as in claim 1 in which a sponge is interposed between said back board and said laminate of the stacked cover sheets secured onto said back board to be fixedly secured to said back board.

* * * * *